US010476195B2

(12) United States Patent
Duan et al.

(10) Patent No.: US 10,476,195 B2
(45) Date of Patent: Nov. 12, 2019

(54) ELECTRICAL RECEPTACLE CONNECTOR

(71) Applicant: Advanced Connectek Inc., New Taipei (TW)

(72) Inventors: Shu-Lin Duan, New Taipei (TW); Wei Wan, New Taipei (TW); Fei-Wu Dong, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 15/915,036

(22) Filed: Mar. 7, 2018

(65) Prior Publication Data

US 2018/0261949 A1 Sep. 13, 2018

(30) Foreign Application Priority Data

Mar. 8, 2017 (CN) ..... 2017 1 0135177

(51) Int. Cl.
*H01R 13/6585* (2011.01)
*H01R 13/506* (2006.01)
*H01R 13/405* (2006.01)

(52) U.S. Cl.
CPC ..... *H01R 13/506* (2013.01); *H01R 13/405* (2013.01); *H01R 13/6585* (2013.01)

(58) Field of Classification Search
CPC ..... H01R 13/6585
USPC ..... 439/607.11
See application file for complete search history.

(56) References Cited

U.S. PATENT DOCUMENTS 8,021,188 B1 * 9/2011 Ma ..... H01R 12/722 439/607.55
9,178,319 B2 * 11/2015 Little ..... H01R 13/6585
9,300,095 B2 * 3/2016 Lin ..... H01R 24/60
9,444,189 B1 * 9/2016 Sattazahn ..... H01R 13/6461
9,502,837 B2 * 11/2016 Kao ..... H01R 24/60
9,620,904 B2 * 4/2017 Kao ..... H01R 13/6581
9,647,377 B1 * 5/2017 Peng ..... H01R 13/405
9,673,569 B2 * 6/2017 Zhang ..... H01R 13/6585
9,768,560 B2 * 9/2017 Yao ..... H01R 13/6594
9,812,818 B2 * 11/2017 Tsai ..... H01R 13/6596
9,843,142 B2 * 12/2017 Hack ..... H01R 13/6583
9,853,399 B2 * 12/2017 Kao ..... H01R 13/6585
9,912,106 B2 * 3/2018 Yao ..... H01R 13/6594
9,917,405 B2 * 3/2018 Ju ..... H01R 13/6585
9,935,401 B2 * 4/2018 Tsai ..... H01R 13/652
9,960,552 B2 * 5/2018 Tsai ..... H01R 24/64
9,985,393 B2 * 5/2018 Zhao ..... H01R 12/58
9,991,652 B2 * 6/2018 Tsai ..... H01R 13/516
10,003,161 B2 * 6/2018 Tsai ..... H01R 13/6591
10,050,365 B1 * 8/2018 Ju ..... H01R 13/502
(Continued)

*Primary Examiner* — Neil Abrams
(74) *Attorney, Agent, or Firm* — JCIPRNET

(57) ABSTRACT

An electrical receptacle connector includes a plurality of lower terminals, a lower insulator, a shielding plate, a plurality of upper terminals, an upper insulator and an outer insulator. The lower insulator partially covers the lower terminals and exposes a lower contact area of a lower contact segment of each lower terminal. The shielding plate is assembled onto the lower insulator. The upper insulator partially covers the upper terminals, exposes an upper contact area of an upper contact segment of each upper terminal, and is assembled onto the lower insulator. The outer insulator partially covers the above elements, and exposes the lower contact areas and the upper contact areas.

14 Claims, 7 Drawing Sheets

(56) References Cited

U.S. PATENT DOCUMENTS

| | | | | |
|---|---|---|---|---|
| 10,096,936 | B2 * | 10/2018 | Ju | H01R 13/6275 |
| 10,153,596 | B2 * | 12/2018 | Lin | H01R 12/7005 |
| 10,170,867 | B2 * | 1/2019 | Ju | H01R 13/6585 |
| 10,218,134 | B2 * | 2/2019 | Tsai | H01R 13/6585 |
| 10,367,313 | B2 * | 7/2019 | Wu | H01R 13/6597 |
| 2019/0131748 | A1 * | 5/2019 | Cheng | H01R 13/6597 |
| 2019/0229470 | A1 * | 7/2019 | Cheng | H01R 13/6585 |

* cited by examiner

ELECTRICAL RECEPTACLE CONNECTOR

CROSS-REFERENCE TO RELATED APPLICATION

This application claims the priority benefit of China patent application serial no. 201710135177.6, filed on Mar. 8, 2017. The entirety of the above-mentioned patent application is hereby incorporated by reference herein and made a part of the specification.

BACKGROUND

1. Field of the Disclosure

The disclosure relates to an electrical connector, and more particularly, relates to an electrical receptacle connector.

2. Description of Related Art

An electrical connector is common component on an electronic device and can be connected with another matching electrical connector on another electronic device so as to serve as a medium for transmitting signals and power between the two electronic devices. A common type of electrical connector is, for example, a universal serial bus (USB). Recently, Type C electronic electrical connector specification has been added in USB protocol to not only provide high data transmission speed of 10 Gbps but also provide a plug-in interface in symmetrical shape for allowing upside-up and upside-down plugging, and is thus widely applied in various electronic devices such as notebook computers. Owing to larger number and smaller size of components, a USB Type C electrical receptacle connector needs many assembly steps during a manufacturing process thereof, resulting in increases in the manufacturing cost as well as increases in the number of bad products.

SUMMARY

The disclosure is directed to an electrical receptacle connector, which is configured to be assembled inside an electronic device for interconnecting with a matching plug electrical connector.

An electrical receptacle connector of the disclosure is adapted to be assembled onto a circuit board. The electrical receptacle connector includes a plurality of lower terminals, a lower insulator, a shielding plate, a plurality of upper terminals, an upper insulator and an outer insulator. Each of the lower terminals has a lower contact segment, a lower soldering segment and a lower extending segment. The lower extending segment is connected to the corresponding lower contact segment and the corresponding lower soldering segment, and each of the lower contact segments has a lower contact area. The lower insulator partially covers the lower contact segments and the lower extending segments and exposes the lower contact areas. The shielding plate is assembled onto the lower insulator. The upper terminal has an upper contact segment, an upper soldering segment and an upper extending segment. The upper extending segment is connected to the corresponding upper contact segment and the corresponding upper soldering segment, and each of the upper contact segments has an upper contact area. The upper insulator partially covers the lower contact segments and the lower extending segments, exposes the upper contact areas, and is assembled onto the lower insulator. The outer insulator partially covers the lower terminals, the lower insulator, the shielding plate, the upper terminals and the upper insulator, and exposes the lower contact areas and the upper contact areas.

In an embodiment of the disclosure, the lower insulator has a plurality of lower engaging portions, the shielding plate has a plurality of shielding engaging portions, and the shielding engaging portions are respectively engaged with the lower engaging portions.

In an embodiment of the disclosure, the lower insulator has a plurality of lower engaging portions, the upper insulator has a plurality of upper engaging portions, and the upper engaging portions are respectively engaged with the lower engaging portions.

In an embodiment of the disclosure, the lower soldering segments are vertical soldering legs, and the upper soldering segments are horizontal soldering legs.

In an embodiment of the disclosure, the shielding plate has a pair of shielding contact areas, the pair of shielding contact areas are located on two opposite lateral edges of the shielding plate, and the outer insulator exposes the pair of the shielding contact areas.

In an embodiment of the disclosure, the shielding plate has a plurality of metal sections, and the outer insulator exposes the metal sections.

In an embodiment of the disclosure, the electrical receptacle connector is compatible with a USB TYPE-C specification standard.

Based on the above, in the disclosure, the lower contact segments are positioned by partially covering the lower contact segments with the lower insulator, and the upper contact segments are positioned by partially covering the upper contact segments with the upper insulator. Lastly, the lower terminals, the lower insulator, the shielding plate, the upper terminals and the upper insulator are partially covered with the outer insulator. In this way, during manufacturing process of the electrical receptacle connector, another insulator for partially covering the shielding plate and positioning the lower terminals as used in the conventional technology can be omitted.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1A:
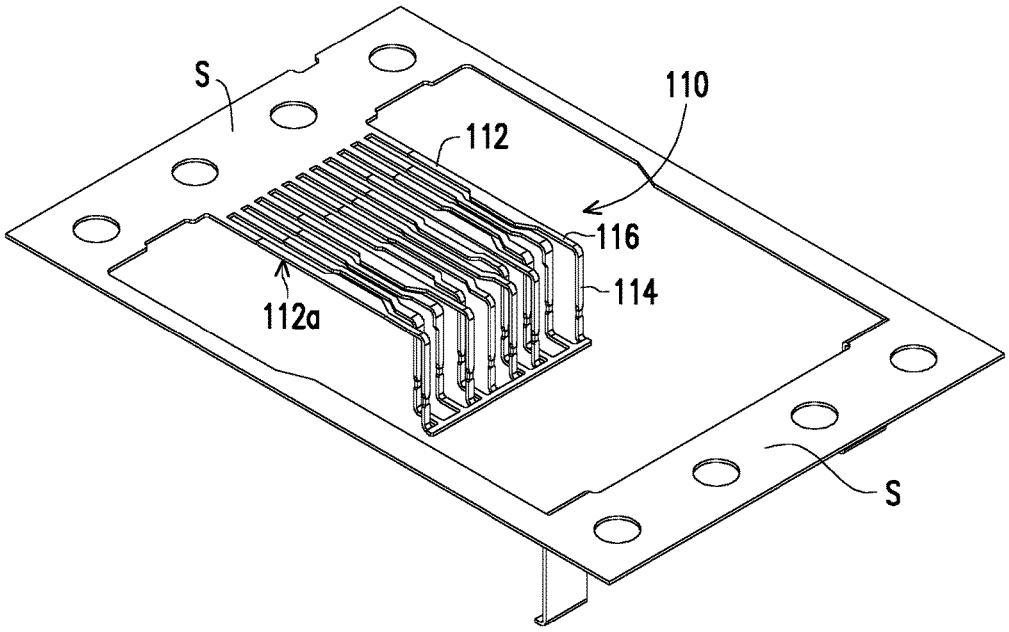
FIG. 1A is a perspective view of a plurality of lower terminals of an electrical receptacle connector according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Figure 7A:
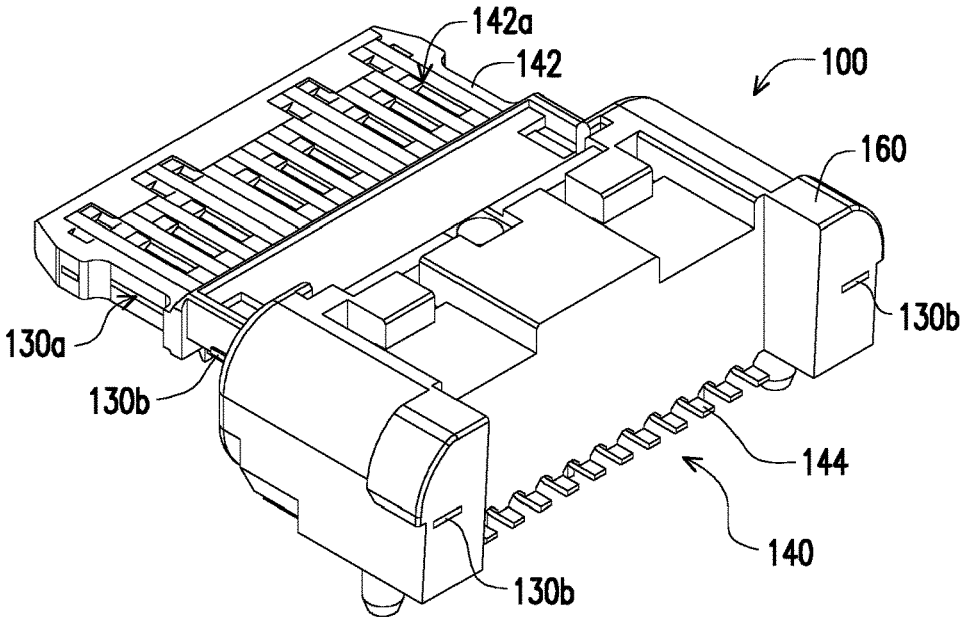
FIG. 7A is a perspective view of the electrical receptacle connector of FIG. 6 from one viewing angle.
Figure 7B:
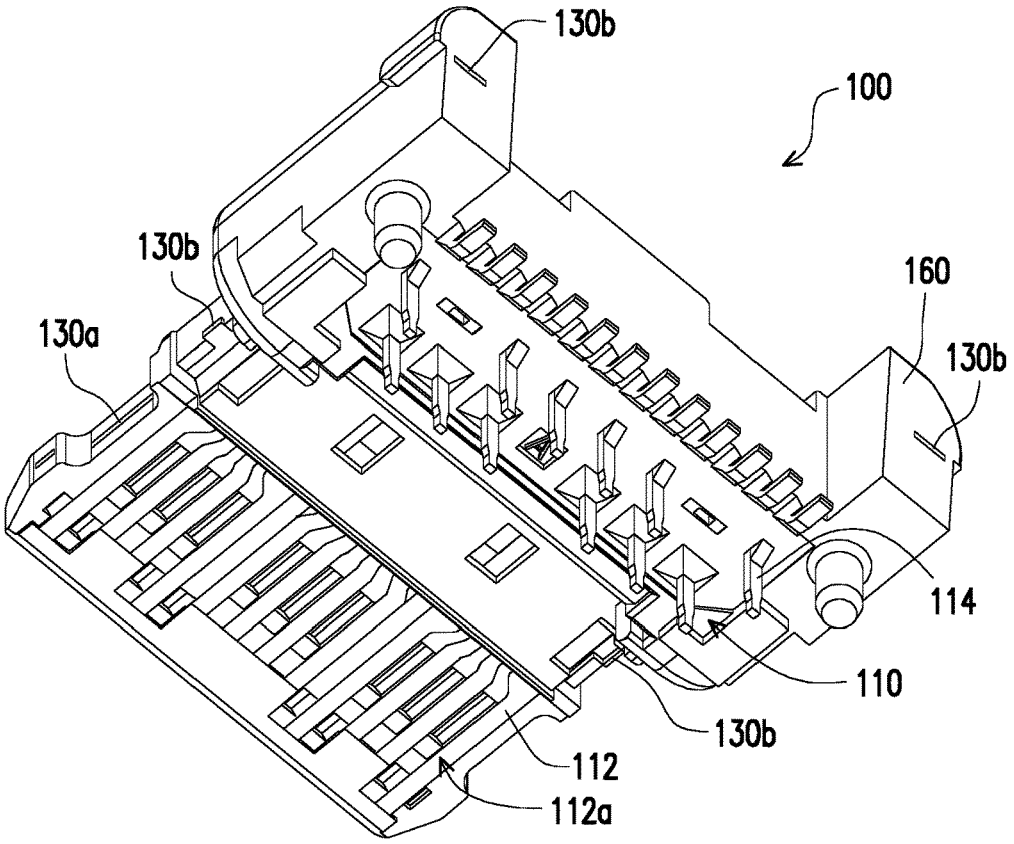
FIG. 7B is a perspective view of the electrical receptacle connector of FIG. 7A from another viewing angle.
Figure 8A:
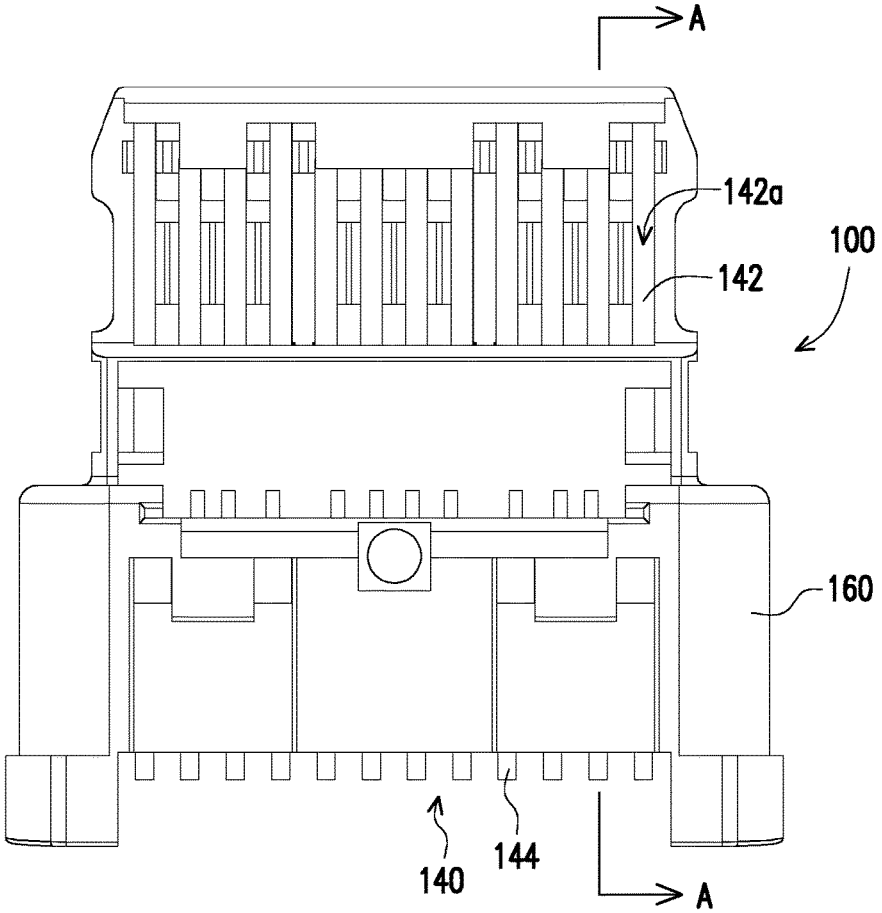
FIG. 8A is a top view of the electrical receptacle connector of FIG. 7A.
Figure 8B:
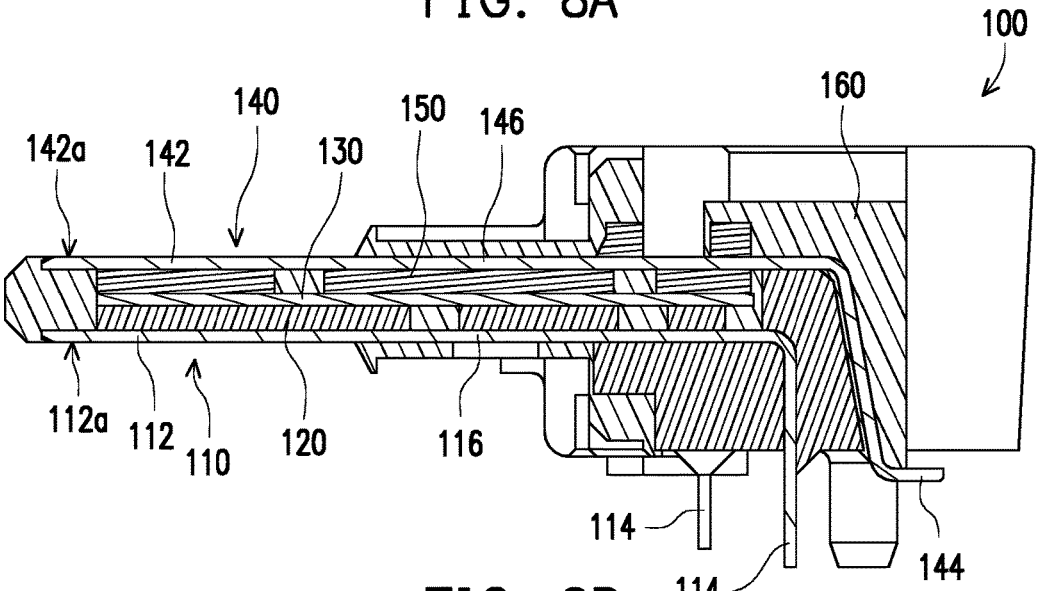
FIG. 8B is a cross-sectional view of the electrical receptacle connector of FIG. 8A along line A-A.

In this embodiment, a manufacturing method of an electrical receptacle connector (as shown by FIG. 7A and FIG. 7B) adapted to be assembled onto a circuit board is disclosed. In the manufacturing method, a plurality of lower terminals, a shielding plate and a plurality of upper terminals are provided, and a lower insulator, an upper insulator and an outer insulator are formed through an injection molding process for partially covering and positioning the lower terminals, the shielding plate and the upper terminals.

With reference to FIG. 1A, a plurality of lower terminals 110 are provided for an electrical receptacle connector 100 through a strip S. Each of the lower terminals 110 has a lower contact segment 112, a lower soldering segment 114 and a lower extending segment 116. The lower extending segment 116 is connected to the corresponding lower contact segment 112 and the corresponding lower soldering segment 114, and each of the lower contact segments 112 has a lower contact area 112*a* (which can also be seen in FIG. 7B).

Figure 1B:
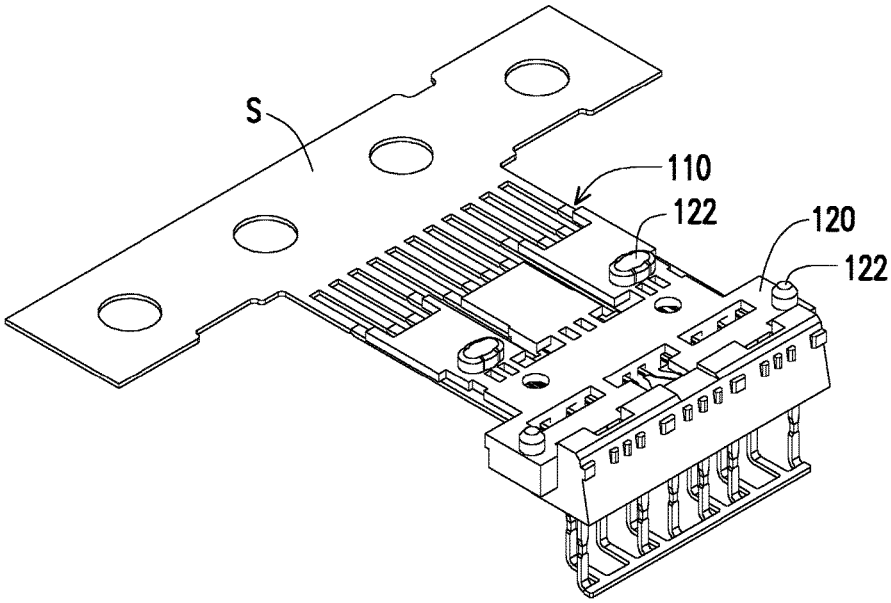
FIG. 1B is a perspective view of a lower insulator formed to partially cover the lower terminals of FIG. 1A.

With reference to FIG. 1B, a lower insulator 120 is formed through an injection molding process to partially cover the lower terminals 110. The lower insulator 120 partially covers the lower contact segments 112 and the lower extending segments 116 and exposes the lower contact areas 112*a*. To achieve insulation and positioning functions, in other embodiments, the lower insulator 120 may be divided into portions to cover the lower contact segments 112 and the lower extending segments 116. In FIG. 1B, after the lower insulator 120 is formed through the injection molding process, a part of the strip S is cut off.

Figure 2:
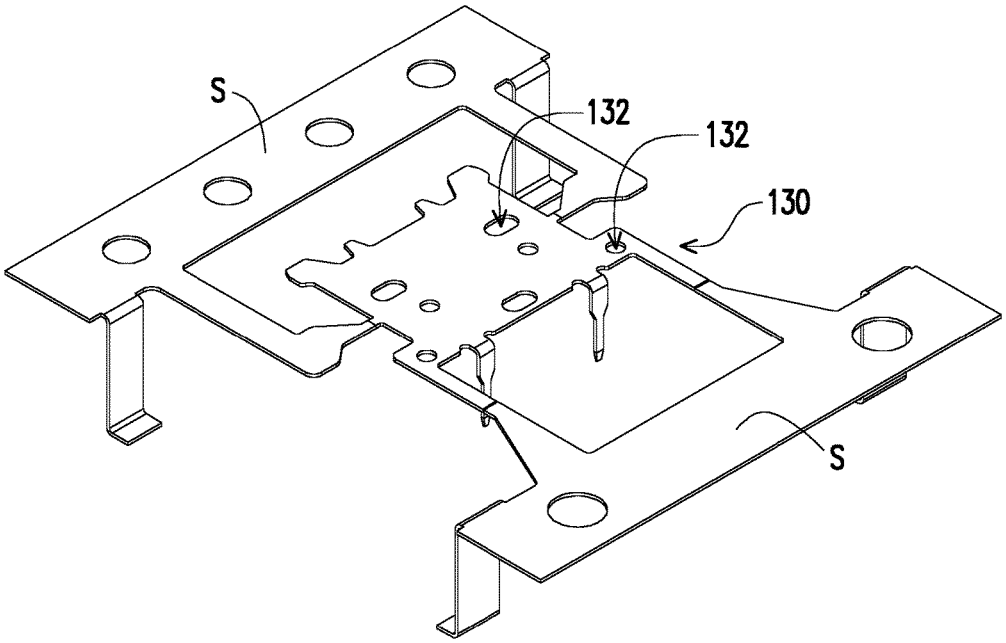
FIG. 2 is a perspective view of a shielding plate of the electrical receptacle connector.
Figure 3:
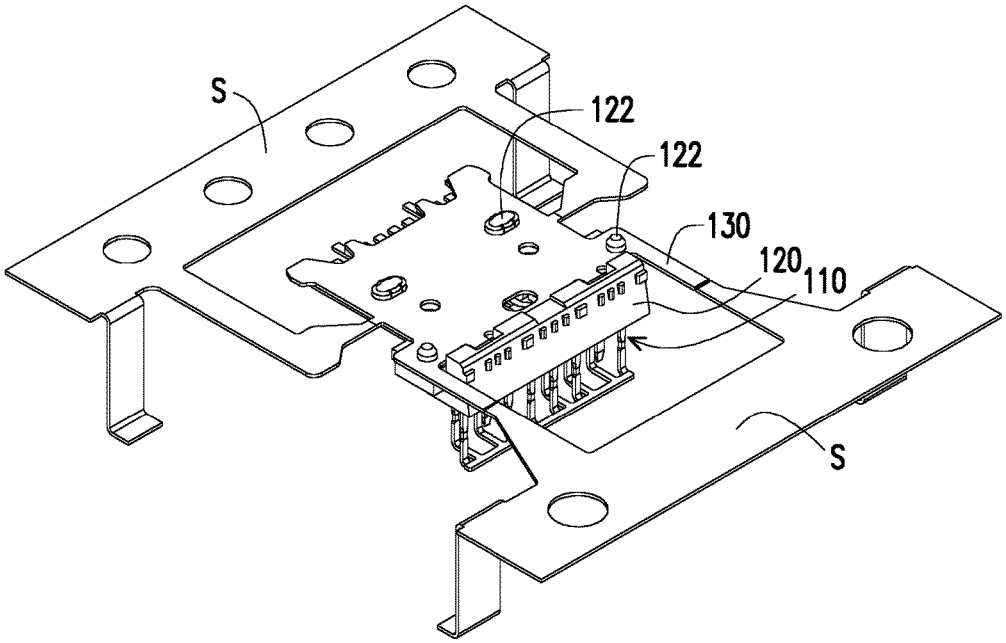
FIG. 3 is a perspective view of the shielding plate of FIG. 2 assembled onto the lower insulator of FIG. 1B.

With reference to FIG. 2, a shielding plate 130 is provided for the electrical receptacle connector 100 through the strip S. Referring to FIG. 1B and FIG. 2 together, the lower insulator 120 has a plurality of lower engaging portions 122 (e.g., a plurality of engaging pillars), and the shielding plate 130 has a plurality of shielding engaging portions 132 (e.g., a plurality of engaging holes). With reference to FIG. 3, the shielding plate 130 is assembled onto the lower insulator 120 by engaging the lower engaging portions 122 of FIG. 1B with the shielding engaging portions 132 of FIG. 2, respectively.

Figure 4A:
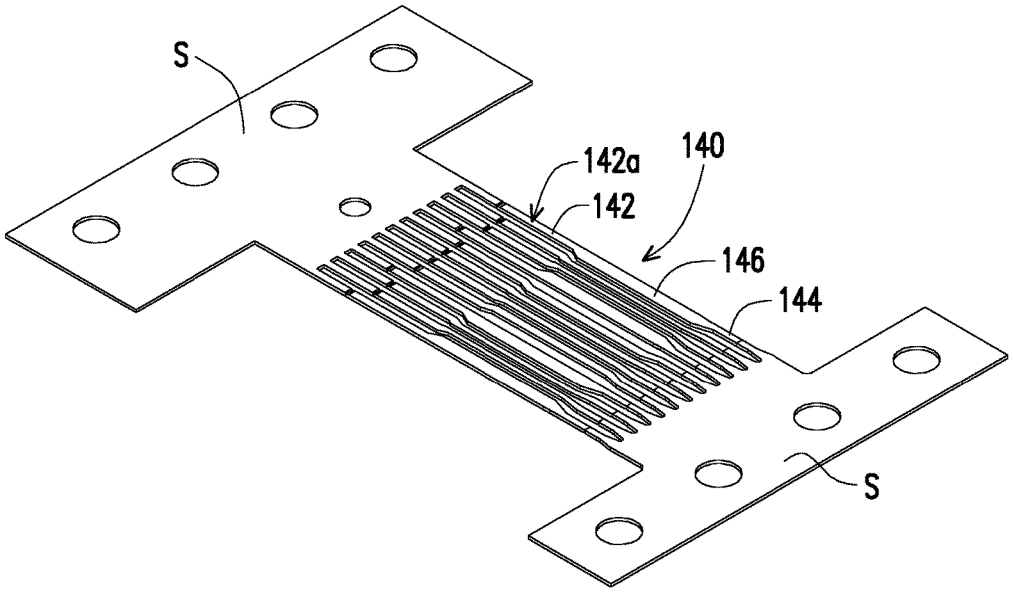
FIG. 4A is a perspective view of a plurality of upper terminals of the electrical receptacle connector.

With reference to FIG. 4A, a plurality of upper terminals 140 are provided for the electrical receptacle connector 100 through the strip S. Each of the upper terminals 140 has an upper contact segment 142, an upper soldering segment 144 and an upper extending segment 146. The upper extending segment 146 is connected to the corresponding upper contact segment 142 and the corresponding upper soldering segment 144, and each of the upper contact segments 142 has an upper contact area 142*a*.

Figure 4B:
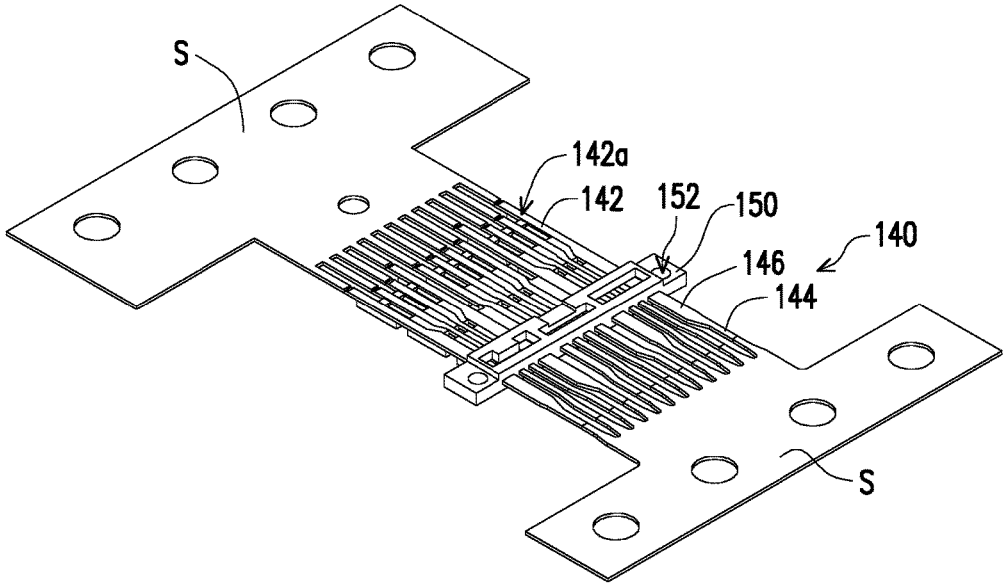
FIG. 4B is a perspective view of an upper insulator formed to partially cover the upper terminals of FIG. 4A.
Figure 4C:
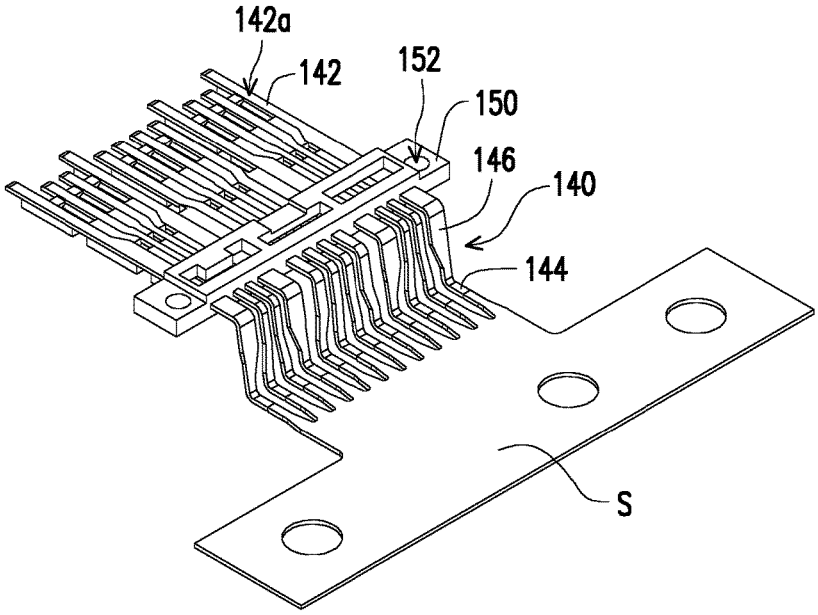
FIG. 4C is a perspective view of upper extending segments of the upper terminals of FIG. 4B being bent.
Figure 5:
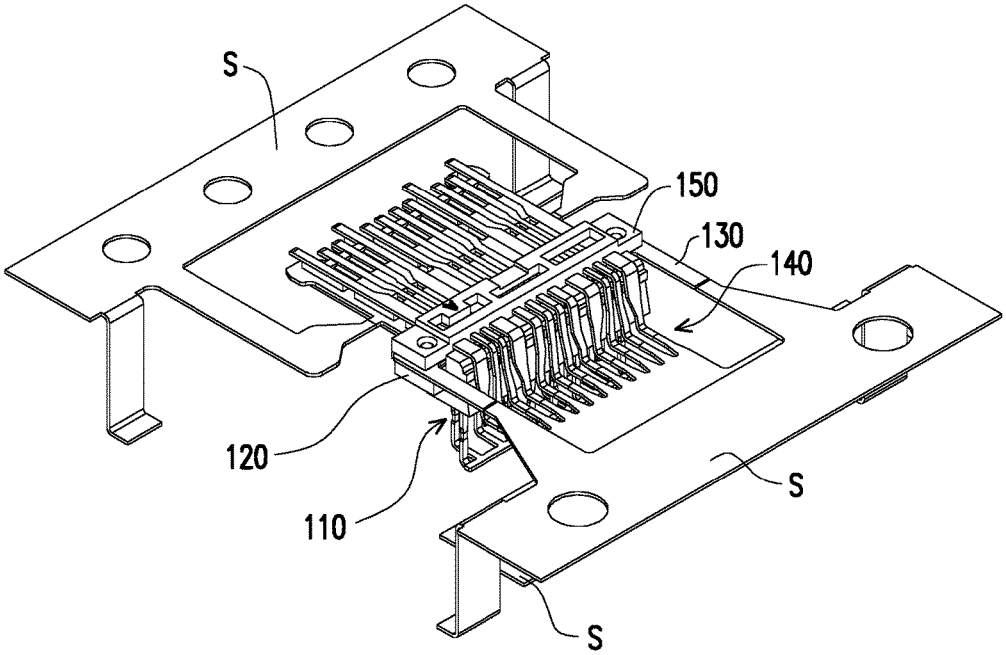
FIG. 5 is a perspective view of the upper insulator of FIG. 4C assembled onto the lower insulator of FIG. 3.

With reference to FIG. 4B, an upper insulator 150 is formed through the injection molding process to partially cover the upper terminals 140. The upper insulator 150 partially covers the upper contact segments 142 and the upper extending segments 146 and exposes the upper contact areas 142*a*. To achieve insulation and positioning functions, in other embodiments, the upper insulator 150 may be divided into portions to cover the upper contact segments 146, and may also expose a portion of each of the lower extending segments 116. In FIG. 4C, after the upper insulator 150 is formed, the upper extending segments 146 are bent, and then a part of the strip S is cut off.

With reference to FIG. 3, FIG. 4B, FIG. 4C and FIG. 5, the upper insulator 150 has a plurality of upper engaging portions 152 (e.g., a plurality of engaging holes), and the upper engaging portions 152 are respectively engaged with the lower engaging portions 122 such that the upper insulator 150 is assembled onto the lower insulator 120. By doing so, the shielding plate 130 is located between the lower terminals 110 and the upper terminals 140 to provide shielding function.

Figure 6:
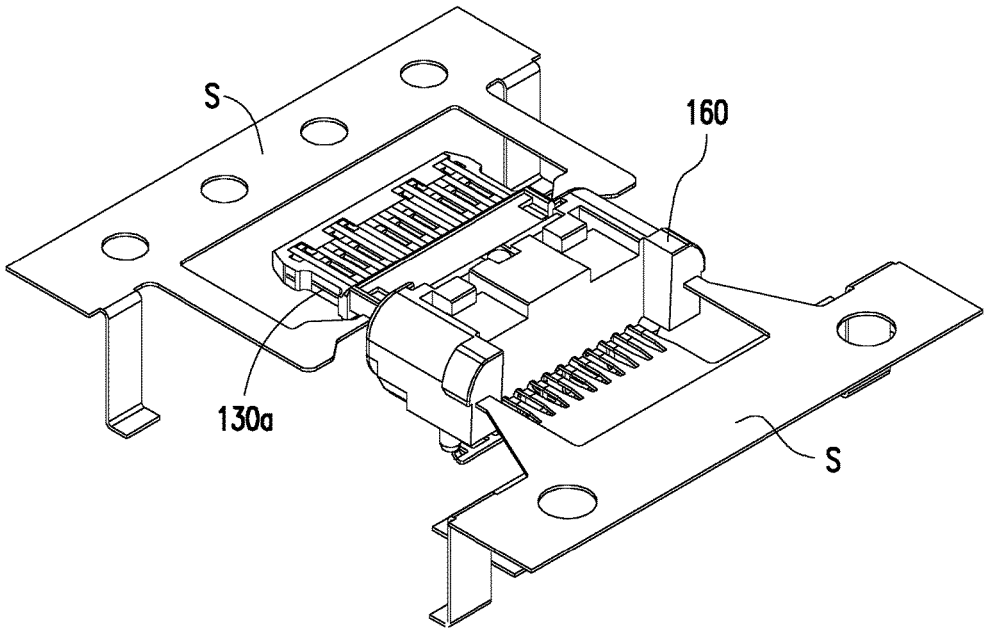
FIG. 6 is a perspective view of the electrical receptacle connector constituted after an outer insulator is formed to partially cover the components of FIG. 5.

With reference to FIG. 6, the outer insulator 160 formed through the injection molding process partially covers the lower terminals 110, the lower insulator 120, the shielding plate 130, the upper terminals 140 and the upper insulator 150, and exposes the lower contact areas 112*a* and the upper contact areas 142*a*. Referring to FIG. 7A and FIG. 7B together, the electrical receptacle connector 100 is completed after the strip S is removed.

With reference to FIG. 7B, in this embodiment, the lower soldering segments 114 may be vertical soldering legs (i.e., DIP soldering legs), and the upper soldering segments 144 may be horizontal soldering legs (i.e., SMT soldering leg).

Referring to FIG. 7A and FIG. 7B together, in this embodiment, the shielding plate 130 may have a pair of shielding contact areas 130*a*. The pair of shielding contact areas 130*a* are located on two opposite lateral edges of the shielding plate 130, and the outer insulator 160 exposes the pair of the shielding contact areas 130*a*.

Referring to FIG. 7A and FIG. 7B together, in this embodiment, the electrical receptacle connector 100 may be compatible with a USB TYPE-C specification standard, but the disclosure is not limited thereto.

Referring to FIG. 7A, FIG. 7B, FIG. 8A and FIG. 8B together, in this embodiment, the electrical receptacle connector 100 includes the lower terminals 110, the lower insulator 120, the shielding plate 130, the upper terminals 140, the upper insulator 150 and the outer insulator 160. The lower extending segment 116 of each of the lower terminal 110 is connected to the corresponding lower contact segment 112 and the corresponding lower soldering segment 114, and each of the lower contact segments 112 has a lower contact area 112*a*. The lower insulator 120 partially covers the lower contact segments 112 and the lower extending segments 116 and exposes the lower contact areas 112*a*. The shielding plate 130 is assembled onto the lower insulator 120. The upper extending segment 146 of each of the upper terminals 140 is connected to the corresponding upper contact segment 142 and the corresponding upper soldering segment 144. The upper insulator 150 partially covers the lower contact segments 112 and the lower extending segments 116, exposes the upper contact areas 142*a*, and is assembled onto the lower insulator 120. The outer insulator 160 partially covers the lower terminals 110, the lower insulator 120, the shielding plate 130, the upper terminals 140 and the upper insulator 150, and exposes the lower contact areas 112*a* and the upper contact areas 142*a*.

Referring to FIG. 7A and FIG. 7B together, the shielding plate 130 has a plurality of metal sections 130*b*, and the outer insulator 160 exposes the metal sections 130*b*. Specifically, after the strip S of FIG. 6 is removed, the metal sections 130*b* are formed at junctions between the shielding plate 130 and the strip S.

In summary, in the disclosure, the lower contact segments are positioned by partially covering the lower contact segments with the lower insulator, and the upper contact segments are positioned by partially covering the upper contact segments with the upper insulator. Lastly, the lower terminals, the lower insulator, the shielding plate, the upper terminals and the upper insulator are partially covered with the outer insulator. In this way, during manufacturing process of the electrical receptacle connector, another insulator for partially covering the shielding plate and positioning the lower terminals as used in the conventional technology can be omitted.

Although the present disclosure has been described with reference to the above embodiments, it is apparent to one of the ordinary skill in the art that modifications to the described embodiments may be made without departing from the spirit of the present disclosure. Accordingly, the scope of the present disclosure will be defined by the attached claims not by the above detailed descriptions.

What is claimed is:

1. An electrical receptacle connector, comprising:

a plurality of lower terminals, each of the lower terminals having a lower contact segment, a lower soldering segment and a lower extending segment, wherein the lower extending segment is connected to the corresponding lower contact segment and the corresponding lower soldering segment, and each of the lower contact segments has a lower contact area;

a lower insulator, partially covering the lower contact segments and the lower extending segments, wherein the lower contact areas are exposed in the air, an end of each of the lower contact segments is extending outwardly from the lower insulator and suspended in the air, and an end of each of the lower contact segments extends straight and has a bevel face;

a plurality of upper terminals, each of the upper terminals having an upper contact segment, an upper soldering segment and an upper extending segment, wherein the upper extending segment is connected to the corresponding upper contact segment and the corresponding upper soldering segment, and each of the upper contact segments has an upper contact area;

an upper insulator, partially covering the upper contact segments and the upper extending segments and being assembled onto the lower insulator, wherein the upper contact areas are exposed in the air, an end of each of the upper contact segments extending outwardly from the upper insulator and suspended in the air, and an end of each of the upper contact segments extends straight and has a bevel face;

a shielding plate, disposed between the lower insulator and the upper insulator; and an outer insulator, partially covering the lower terminals, the lower insulator, the shielding plate, the upper terminals and the upper insulator, and covering the bevel faces of the lower contact segments and the bevel faces of the upper contact segments.

2. The electrical receptacle connector according to claim 1, wherein the lower insulator has a plurality of lower engaging portions, the shielding plate has a plurality of shielding engaging portions, and the shielding engaging portions are respectively engaged with the lower engaging portions.

3. The electrical receptacle connector according to claim 2, wherein the shielding engaging portion is an engaging hole.

4. The electrical receptacle connector according to claim 2, wherein the lower engaging portion is an engaging pillar.

5. The electrical receptacle connector according to claim 1, wherein the lower insulator has a plurality of lower engaging portions, the upper insulator has a plurality of upper engaging portions, and the upper engaging portions are respectively engaged with the lower engaging portions.

6. The electrical receptacle connector according to claim 5, wherein the upper engaging portion is an engaging hole.

7. The electrical receptacle connector according to claim 1, wherein the lower soldering segments are vertical soldering legs, and the upper soldering segments are horizontal soldering legs.

8. The electrical receptacle connector according to claim 1, wherein the shielding plate has a pair of shielding contact areas, the pair of shielding contact areas are located on two opposite lateral edges of the shielding plate, and the outer insulator exposes the pair of the shielding contact areas.

9. The electrical receptacle connector according to claim 1, wherein the shielding plate has a plurality of metal sections, and the outer insulator exposes the metal sections.

10. The electrical receptacle connector according to claim 1, wherein the electrical receptacle connector is compatible with a USB TYPE-C specification standard.

11. The electrical receptacle connector according to claim 1, wherein the shielding plate is assembled onto the lower insulator.

12. An electrical receptacle connector, comprising:

a plurality of lower terminals, each of the lower terminals having a lower contact segment, a lower soldering segment and a lower extending segment, wherein the lower extending segment is connected to the corresponding lower contact segment and the corresponding lower soldering segment, and each of the lower contact segments has a lower contact area;

a lower insulator, partially covering the lower contact segments and the lower extending segments, wherein the lower contact areas are exposed in the air, and an end of each of the lower contact segments is extending outwardly from the lower insulator and suspended in the air;

a plurality of upper terminals, each of the upper terminals having an upper contact segment, an upper soldering segment and an upper extending segment, wherein the upper extending segment is connected to the corresponding upper contact segment and the corresponding upper soldering segment, and each of the upper contact segments has an upper contact area;

an upper insulator, partially covering the upper contact segments and the upper extending segments and being assembled onto the lower insulator, wherein the upper contact areas are exposed in the air, an end of each of the upper contact segments is extending outwardly from the upper insulator and suspended in the air, the upper extending segments are partially exposed in the air, and the upper soldering segments are suspended in the air and are not covered by the upper insulator;

a shielding plate, disposed between the lower insulator and the upper insulator; and an outer insulator, partially covering the lower terminals, the lower insulator, the shielding plate, the upper terminals and the upper insulator, covering the end of each of the lower contact segments and the end of each of the upper contact segments, and partially covering the upper extending segments and the upper soldering segments.

13. The electrical receptacle connector according to claim 12, wherein an end of each of the lower contact segments extends straight and has a bevel face and an end of each of the upper contact segments extends straight and has a bevel face.

14. The electrical receptacle connector according to claim 13, wherein the outer insulator covers the bevel faces of the lower contact segments and the bevel faces of the upper contact segments.

* * * * *